United States Patent [19]

Bolldorf et al.

[11] 4,289,086

[45] Sep. 15, 1981

[54] NEEDLE BAR COUPLING IN AN EMBROIDERING MACHINE

[75] Inventors: Kurt Bolldorf, Kaiserslautern; Ernst Brückner, Neuwied, both of Fed. Rep. of Germany.

[73] Assignee: Pfaff Industriemaschinen GmbH, Fed. Rep. of Germany

[21] Appl. No.: 188,947

[22] Filed: Sep. 19, 1980

[30] Foreign Application Priority Data

Sep. 26, 1979 [DE] Fed. Rep. of Germany ..... 7927287

[51] Int. Cl.[3] ..... D05B 55/16

[52] U.S. Cl. ..... 112/221

[58] Field of Search ..... 112/221, 79 R, 79 A, 112/98, 83, 84

[56] References Cited

U.S. PATENT DOCUMENTS 3,695,199 10/1972 Rolauffs et al. ..... 112/221
4,064,816 12/1977 Spanel et al. ..... 112/221 X
4,098,207 7/1978 Peterson ..... 112/221

FOREIGN PATENT DOCUMENTS 2749700 5/1979 Fed. Rep. of Germany ..... 112/221

*Primary Examiner*—H. Hampton Hunter
*Attorney, Agent, or Firm*—McGlew and Tuttle

[57] ABSTRACT

A needle bar coupling in an embroidering machine which has a plurality of needle bars driven by separate cranks operated by a drive shaft, comprises a crank which is connected to the needle bar and to the drive shaft to move the needle bar upon rotation of the shaft. For this purpose a coupling or collar is engaged on the shaft and it carries the crank. A pawl is pivoted on the crank and it includes a tooth portion which engages in a groove of the coupling so that the coupling drives the crank when the shaft is rotated. In order to disengage the crank and the needle bar drive a contact member is provided adjacent the pawl which is shifted to engage the pawl and dislodge the tooth of the pawl from the coupling.

4 Claims, 1 Drawing Figure

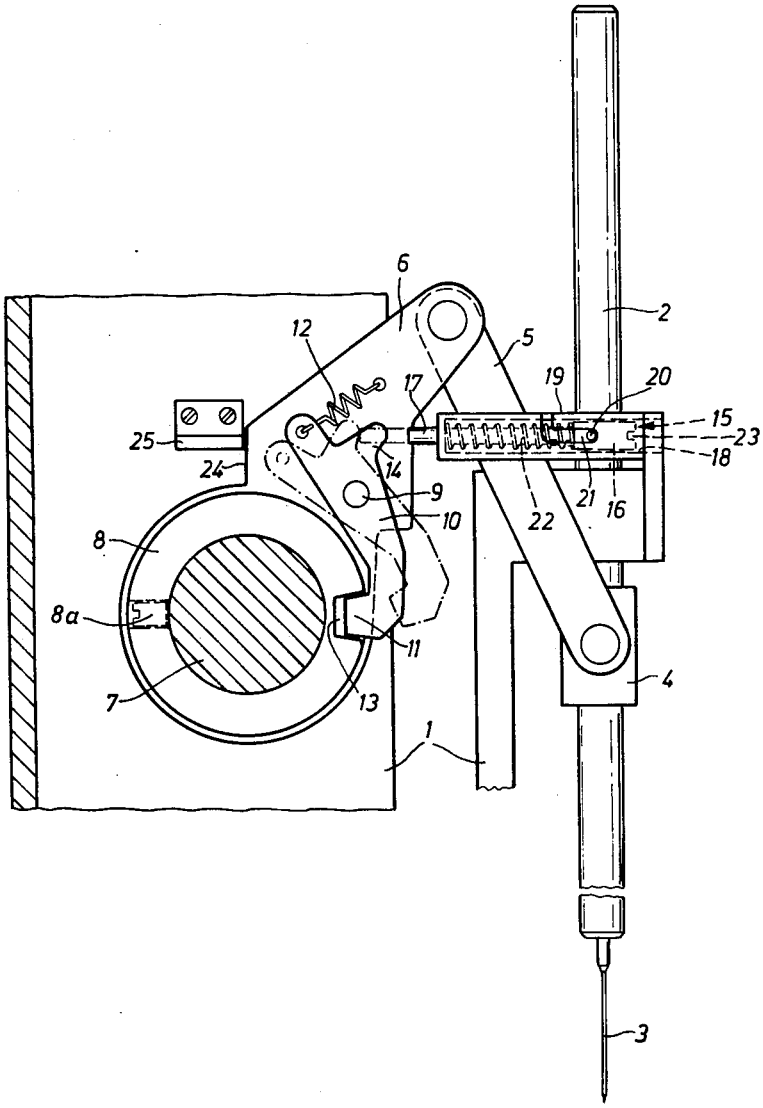
6
2
12
5
17
19
20
15
23
18
25
24
14
9
10
22
21
16
8
8a
11
4
7
13
1
3

NEEDLE BAR COUPLING IN AN EMBROIDERING MACHINE

FIELD AND BACKGROUND OF THE INVENTION

This invention relates in general to embroidering or sewing machines and in particular to a new and useful needle bar coupling in an emboidering machine.

A needle bar coupling (DAS No. 2749700) serves in an embroidering machine with a plurality of juxtaposed stitch-forming points to temporatily interrupt the needle bar movement at various embroidering pattern points. In a known needle bar coupling, the coupling takes place between the needle bar and a follower driven over the crank and the guide rod which extends parallel to the needle bar. In the known arrangement, the movement of the crank, of the guide rod and of the follower cannot be interrupted, they therefore, swing uselessly when the needle bar is disconnected.

SUMMARY OF THE INVENTION

The invention substantially simplifies the coupling connection between the drive and the needle bar and reduces the number of parts swinging when the needle bar is disconnected.

Due to the measure according to the invention, the coupling is now moved to the drive shaft and in a simple embodiment of the needle bar drive, with the needle bar disconnected, the disconnection of the swinging parts driving the needle bar is also achieved.

Accordingly, it is an object of the invention to provide a needle bar coupling for an embroidering machine which includes a drive shaft with a coupling around the shaft connected through a pawl to a crank and wherein the pawl has a tooth portion engaged in the coupling to permit driving and it is mounted to be pivoted so that the tooth is moved out of the groove by a contact member so as to disengage the crank from the shaft.

A further object of the invention is to provide a needle bar coupling construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a partial sectional and partial elevational view of a needle bar of a embroidering machine constructed in accordance with the invention.

DESCRIPTION OF THE PREFERRED EMBODIMENT

Referring to the drawing in particular, the invention embodied therein comprises a needle bar coupling for an embroidering machine which has a plurality of needle bars, one of which needle bar 2 is shown which is driven from a drive shaft 7. A coupling 8 is secured to the drive shaft 7 such as by engaging a set screw 8*a* thereto and it is connected to drive a crank 6 through an engageable or disengageable pawl 10. In accordance with the invention the pawl 10 has a tooth 11 which engages in a groove 13 of the coupling when the needle bar 2 is to be driven. The pawl 10 may be disengaged from the coupling by means of a contact member generally designated 15 which includes a contact rod 17 which may be moved to engage a contact arm portion 14 of the pawl 10 to move it against the force of a spring 12 and to lift the tooth 11 out of the groove 13 to stop the driving action.

The figure shows a mounting frame 1 of an embroidering machine which can be equipped with a plurality of needle bars 2. Each of these needle bars 2, which carry needles 3, is connected over a needle bar member 4 and a guide rod 5 with an operating crank 6 which is mounted loosely on a drive shaft 7 which performs oscillating movements. The drive shaft 7 is mounted in mounting frame 1 to drive needle bar 2. Operating crank 6 is guided axially by a coupling ring 8 and an adjusting ring (not shown) secured on drive shaft 7. On operating crank 6 is mounted on an axle 9 a pawl 10. The pawl 10 is provided with a coupling tooth 11 which is pressed, under the action of a spring 12 suspended between pawl 10 and operating crank 6, into a coupling groove 13 in coupling ring 8. Drive shaft 7 is thus coupled with needle bar 2 and effects its ascending and descending movement.

Pawl 10 is provided with a contact arm 14 which opposes a contact member 15 in the upper dead center of needle bar 2. Contact member 15 comprises a guide pilot 16 and a contact rod 17 connected with it, and is displaceably mounted in a bore 18 of a housing 19, which is secured on mounting frame 1. In guide pilot 16 is secured a pin 20 which protrudes into a bent-off groove 21 in housing 19 and thus limits the displacement path of guide pilot 16. A spring 22 mounted in bore 18 about the contact rod 17, holds the contact rod 17 in its retracted position. Guide pilot 16 has at its free end a transverse slot 23 which is directed toward the open end bore 18 of housing 19 and which serves to displace and rotate guide pilot 16 by means of a screwdriver.

On operating crank 6 is provided a stop surface 24 which bears on a registering bar 25 in the upper dead center of needle bar 2.

In the upper dead center of needle bar 2, the operator can move guide pilot 16 by means of a screwdriver against the force of spring 22, whereby contact rod 17 strikes against contact arm 14, turning pawl 10. Coupling tooth 11 lifts from coupling groove 13, since operating crank 6 bears with its stop surface 24 on registering bar 25. By turning pilot 16 in this position, pin 20 moves into the bentoff part of groove 21, and contact rod 17 locks operating crank 6 and thus needle bar 2 in its disconnected position.

In order to couple the needle bar 2 again, guide pilot 16 of contact arm 15 is turned with its pin 20 in the ax-parallel part of groove 21. Spring 22 urges contact rod 17 back into housing 19, so that contact arm 14 is released. Under the action of spring 22, coupling tooth 11 of pawl 10 turns into coupling groove 13 of coupling ring 8 and couples needle bar 2 with drive shaft 7.

While a specific embodiment of the invention has been shown and described in detail to illustrate the application of the principles of the invention, it will be understood that the invention may be embodied otherwise without departing from such principles.

What is claimed is:

1. A needle bar coupling in an embroidering machine having a plurality of needle bars driven by a crank operated by a drive shaft, comprising coupling connected to the needle bar and connected to said drive shaft being rotatable by said drive shaft to move said needle bar, a coupling connected between said crank and said drive shaft fixed to said drive shaft for rotation therewith and having a drive groove, a pawl pivoted on said crank and having a tooth engageable in said drive groove, and a contact member mounted adjacent said pawl and being movable to engage said pawl to move it so that the tooth is disengaged from the groove of said coupling, spring means biasing said pawl in the direction to engage said tooth in said groove.

2. A needle bar coupling according to claim 1, wherein said crank includes a hub portion freely rotatable on the shaft, said coupling comprising a collar secured to said shaft and having said drive groove therein.

3. A needle bar coupling according to claim 1, wherein said pawl includes a contact arm portion projecting outwardly therefrom in the path of movement of said contact member, the range of swinging movement of said pawl being such that said contact arm is positionable always in the path of movement of said contact member.

4. A needle bar coupling according to claim 1, wherein said contact member comprises a housing having a drive member displaceably mounted in said housing and extending outwardly therefrom to engage said pawl, means to bias said member in a direction away from engagement with said pawl, said member having a rotatable part in said housing being rotatable to displace it in a direction to engage said pawl.

* * * * *